US005592763A

United States Patent [19]

Hahnewald et al.

[11] Patent Number: 5,592,763

[45] Date of Patent: Jan. 14, 1997

[54] STEAM DISCHARGE AND STEAM DISTRIBUTION MEANS

[75] Inventors: Andrea Hahnewald, Dreieich, Germany; Augustin Auria, Esplugues de Llobregat, Spain; Miguel Jiminez, Molins de Rei, Spain; Miguel Vazquez, Barcelona, Spain; Francesc Carreras, Sant Just Desvern, Spain; Juan C. Coronado, Barcelona, Spain

[73] Assignee: Braun Aktiengesellschaft, Kronberg, Germany

[21] Appl. No.: 418,177

[22] Filed: Apr. 6, 1995

[30] Foreign Application Priority Data

Apr. 6, 1994 [DE] Germany ..... 44 22 087.1
Apr. 6, 1994 [DE] Germany ..... 44 11 790.6

[51] Int. Cl.[6] ..... D06F 75/20

[52] U.S. Cl. ..... 38/77.9; 38/93

[58] Field of Search ..... 38/77.9, 93, 74, 38/77.5, 77.8, 77.83, 80, 81, 85, 97, 77.7; 219/222, 245, 254, 255, 258

[56] References Cited

U.S. PATENT DOCUMENTS 2,729,004 1/1956 Swanson ..... 38/93
2,906,043 9/1959 Jepson et al. ..... 38/77.7
2,918,739 12/1959 Clearman ..... 38/77.5
3,130,507 4/1964 Hoecker ..... 38/77.5
4,594,800 6/1986 Hermann ..... 38/93 X

FOREIGN PATENT DOCUMENTS

GM-7033464 12/1970 Germany .
3603409C2 12/1986 Germany .
3901024C2 7/1990 Germany .

*Primary Examiner*—Ismael Izaguirre
*Attorney, Agent, or Firm*—Fish & Richardson, P.C.

[57] ABSTRACT

A soleplate for a steam iron includes a plurality of beads. Each bead incorporates therein at least two steam outlet openings. The steam outlet openings located on the side close to the outer edge of the soleplate are larger than the steam outlet openings located on the side remote from the outer edge of the soleplate. The larger steam outlet openings are arranged in the front portion of the soleplate, with the smaller steam outlet openings arranged in the rear portion. The number of steam outlet openings per bead increases towards the pointed end of the soleplate.

6 Claims, 2 Drawing Sheets

STEAM DISCHARGE AND STEAM DISTRIBUTION MEANS

FIELD OF THE INVENTION

This invention relates to steam discharge and distribution means for a steam iron.

BACKGROUND OF THE INVENTION

In steam irons, the aim is to introduce the steam exiting from the steam outlet openings in the soleplate into the article being ironed over a maximum possible surface area and as evenly as possible.

It is known in the art to incorporate into the soleplate of the steam iron a multiplicity of steam outlet openings which are each surrounded by a bead for the purpose of accomplishing an improved distribution of the steam.

To this effect, the soleplate includes vent holes to which steam is delivered through a steam supply channel. This steam supply channel is located in the shoe of the pressing iron. The steam enters this steam supply channel in the rear portion of the pressing iron. Continuing its travel, the steam then flows through the steam supply channel, exiting through the holes in the soleplate to enter the article being ironed.

It is an object of the present invention to provide a steam iron ensuring a discharge of steam over a maximum possible surface area and as evenly as possible.

In state-of-the-art devices known thus far, the steam outlet surface area within a bead has been limited by the size of the steam outlet hole. In cases where the steam outlet hole was too large, it could easily happen that water exited through this steam outlet hole, dripping on the article being ironed. This could lead to water spotting on the article being ironed. Accordingly, in view of the limited size of this hole within its bead, the steam outlet surface area in the individual bead was equally limited in size.

SUMMARY OF THE INVENTION

By providing in the soleplate at least two steam outlet openings per bead as disclosed in the present invention, the steam outlet surface area in the bead is increased without resulting in a hole of a size which could present problems due to dripping water. The steam outlet surface area being distributed on two holes incorporated into the bead, the steam exits at different locations within the bead. The result is an improved steam distribution within the bead.

Embodiments of the invention may include one or more of the following features. The steam outlet, located within a bead on the side close to the outer edge of the pressing surface, is larger than the steam outlet opening located on the side remote from the outer edge of the pressing surface. Thus, an advantageous steam distribution is accomplished because the outer edge of the beads lies on a larger radius than the inner edge of the beads. Because the larger steam outlet openings are located in the area of the outer edge of the beads, a better distribution of steam results on the larger surface of the outer edge of the beads.

At least three steam outlet openings are incorporated into at least one bead, with the steam outlet opening located on the side close to the outer edge being the largest, while the steam outlet opening located on the side remote from the outer edge of the pressing surface is the smallest. Thus, an advantageous configuration is provided when beads are of a specified size, such that the steam outlet surface area is better realized by three steam outlet openings rather than by two steam outlet opening.

The large steam outlet openings located on the side close to the outer edge of the pressing surface lie ahead of the smaller steam outlet openings located on the side remote from the outer edge when viewed in the ironing direction of the pressing surface. Thus, the steam outlet openings located within the individual beads farther away when viewed in the direction of steam flow in the steam supply channel, have an increased outlet surface area. As a result, an improved steam distribution within the bead is accomplished on account of the flow resistance diminishing in the direction of flow.

The number of steam outlet openings within the beads increases towards the pointed end of the pressing surface when viewed in the ironing direction of the pressing surface, with the beads in the region of the pointed end of the pressing surface being larger than the beads in the rear portion of the pressing surface. Thus, an advantageous configuration is provided in that, when viewed in the direction of steam flow in the steam supply channel, overall a larger steam outlet surface area is obtained in the direction of flow.

A predominant number of steam outlet openings is arranged in the forward half of the soleplate. Thus, the distribution of steam over the pressing surface of the pressing iron is optimized when the steam enters the steam supply channel in the rear portion of the pressing iron. The overall larger steam outlet surface area in the forward portion of the pressing iron compensates for the effect that the steam in this forward portion has a reduced pressure because of the direction of steam flow in the steam supply channel.

Further details and advantages of the present invention will become apparent from the subsequent description of an embodiment. In the drawings,

DESCRIPTION OF THE PREFERRED EMBODIMENT

Figure 1:
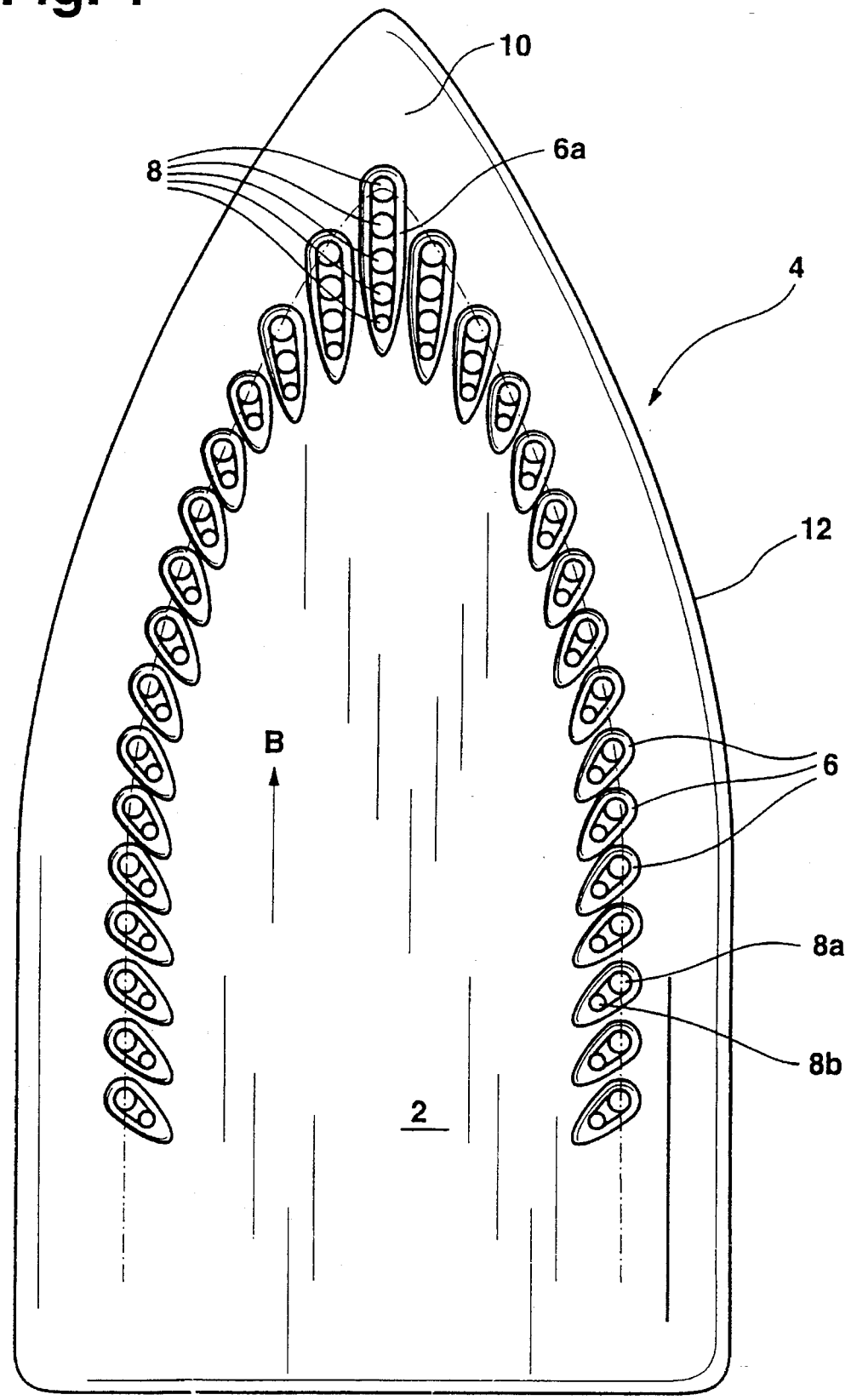
FIG. 1 is a top plan view of the underside (pressing surface) of the soleplate of a steam iron constructed in accordance with the present invention.

Referring now to FIG. 1 of the drawings, there is shown in top plan view the pressing surface 2 of a soleplate 4 made of metal, for example, steel sheet or aluminum. Incorporated into the soleplate 4 are a plurality of beads 6. The beads 6 extend in arched form from the pressing surface 2 into the interior of the soleplate 4. The cross-sectional area of the beads 6 is at its maximum in the plane of the pressing surface 2. Each bead has incorporated therein at least two steam outlet openings 8. When viewed in the ironing direction B, the number of steam outlet openings 8 within a bead becomes greater towards the pointed end 10 of the soleplate 4. In the embodiment of FIG. 1, the bead **6*a* located on the side close to the pointed end 10 includes five steam outlet openings 8**.

In respect of the outer edge 12 of the soleplate 4, the steam outlet openings **8*a* located on the side close to the outer edge 12 are larger than the steam outlet openings 8*b* on the side remote from the outer edge 12. In addition, when viewed in the ironing direction B, the larger steam outlet openings 8*a* lie ahead of the smaller steam outlet openings 8*b***.

Advantageously, the outer steam outlet openings 8*a* are arranged at a constant distance to the outer edge 12 of the soleplate 4. Steam can be delivered to the steam outlet openings 8 through a steam supply channel extending above the soleplate 4. This enables the beads 6 in the pressing surface 2 to be maintained small, so that a large plane surface remains for ironing the article.

Figure 2:
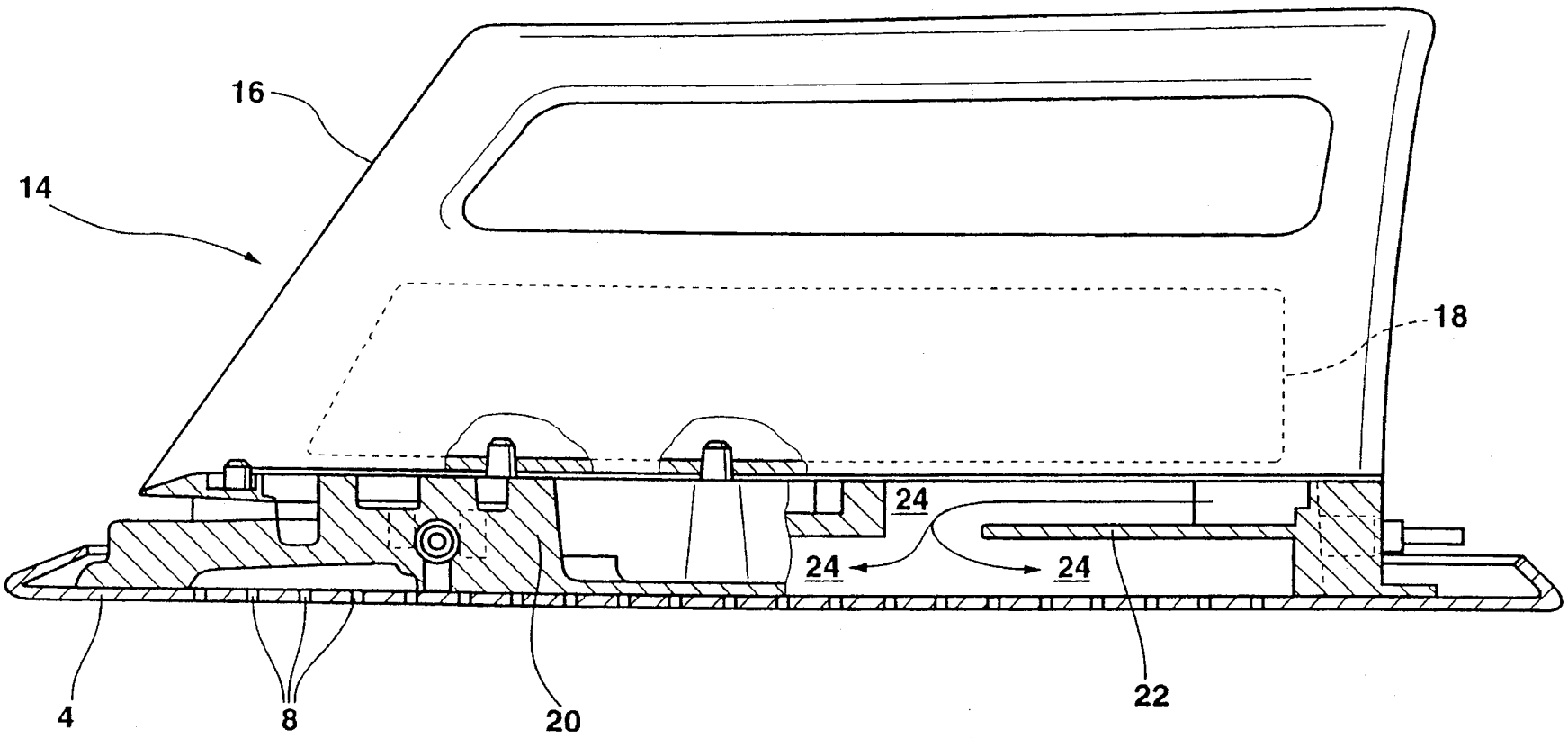
FIG. 2 is a sectional view of a pressing iron of the present invention.

FIG. 2 shows a cross-section through a steam iron 14 having a housing 16 and a fluid reservoir 18. The fluid reservoir 18 is connected to a heatable metal block 20 made, for example, of an aluminum casting, by means of a valve or a passageway. The metal block 20 is connected to the soleplate 4, heating the soleplate 4 when the steam iron 14 is turned on. At the same time, the metal block 20 serves as an evaporator of fluid, mostly water, which is caused to drip onto the metal block 20. The steam generated by the heatable metal block is supplied to the steam outlet openings 8 through a steam supply channel 24 extending above the beads 8. As this occurs, the steam enters the steam supply channel 24 at the rear end of the pressing iron. In a particularly advantageous embodiment, a baffle 22 is provided in the steam supply channel 24 which prevents the steam from exiting immediately through the steam outlet openings in the rear portion of the soleplate as it enters the steam supply channel 24. The steam then travels in the steam supply channel 24 first up to about the center of the soleplate 4 (in the longitudinal direction). From there, the steam moves further upwards to the steam outlet openings as well as below the baffle 22 to the steam outlet openings in the rear portion of the soleplate.

We claim:

1. A soleplate of a steam iron, the soleplate including:

a pressing surface;

a plurality of beads formed in the pressing surface; and a plurality of steam outlet openings located in the soleplate, wherein at least two of the steam outlet openings are located in one of the beads, a first one of the at least two steam outlet openings having a different size than a second one of the at least two steam outlet openings.

2. The soleplate as claimed in claim 1, wherein the first one of the at least two steam outlet openings being located closest to an outer edge of the pressing surface is larger than the second one of the at least two steam outlet openings.

3. The soleplate as claimed in claim 1, wherein the first one of the at least two steam outlet openings located closest to an outer edge of the pressing surface is the largest of the at least two steam outlet openings, wherein the second one of the at least two steam outlet openings located most remote from the outer edge of the pressing surface is the smallest of the at least two steam outlet openings, and wherein a third one of the at least two steam outlet openings is located between the first one of the at least two steam outlet openings and the second one of the at least two steam outlet openings.

4. The soleplate as claimed in claim 1, wherein a larger one of the at least two steam outlet openings is located closest to an outer edge of the pressing surface and lies ahead of other ones of the at least two steam outlet openings that are located more remote from the outer edge of the pressing surface when viewed in an ironing direction of the pressing surface.

5. The soleplate as claimed in claim 1, wherein the number of steam outlet openings within the beads increases towards a pointed end of the pressing surface when viewed in an ironing direction (B) of the pressing surface, with the beads in a region of the pointed end of the pressing surface being larger than the beads in a rear portion of the pressing surface.

6. The soleplate as claimed in claim 5, wherein the steam outlet openings are predominantly arranged in a forward half of the soleplate closest to the pointed end.

* * * * *